US005827044A

United States Patent [19]

Yazici et al.

[11] Patent Number: 5,827,044

[45] Date of Patent: Oct. 27, 1998

[54] FAN SYSTEM WITH VARIABLE AIR VOLUME CONTROL

[76] Inventors: Muammer Yazici, 195 Berry Road, Etobicoke, Ontario, Canada, M8Y 1X2; Werner Richarz, 70 Roxborough Lane, Thornhill, Ontario, Canada, L4J 4S9; George William Donald Wallace, 102 Stanley Avenue, Apt. 1, Etobicoke, Ontario, Canada, M8V 1N9

[21] Appl. No.: 824,663

[22] Filed: Mar. 26, 1997

[51] Int. Cl.[6] ..... F04D 29/44; F04D 29/46

[52] U.S. Cl. ..... 415/132; 415/131; 415/148; 415/150; 415/213.1

[58] Field of Search ..... 415/131, 132, 415/119, 151, 157, 158, 150, 148, 213.1; 416/63

[56] References Cited

U.S. PATENT DOCUMENTS

| | | | |
|---|---|---|---|
| 1,047,279 | 12/1912 | Osius . | |
| 1,078,609 | 11/1913 | Chaney . | |
| 2,083,184 | 6/1937 | Anderson . | |
| 3,695,774 | 10/1972 | Martz et al. . | |
| 3,726,611 | 4/1973 | Astrom | 415/213.1 |
| 3,771,927 | 11/1973 | Schiller . | |
| 3,811,790 | 5/1974 | Mikulina et al. | 415/213.1 |
| 3,861,824 | 1/1975 | Sjoqvist et al. . | |
| 4,135,850 | 1/1979 | d'Anjou . | |
| 4,375,939 | 3/1983 | Mount et al. . | |
| 4,553,404 | 11/1985 | Malchow et al. . | |
| 4,808,068 | 2/1989 | Asbjornson et al. . | |
| 4,859,140 | 8/1989 | Passadore | 415/157 |
| 4,929,150 | 5/1990 | Daw . | |
| 5,035,611 | 7/1991 | Neubecker et al. . | |
| 5,161,941 | 11/1992 | Ratner | 415/157 |
| 5,209,639 | 5/1993 | Neuber et al. | 415/213.1 |
| 5,211,530 | 5/1993 | Shiffler . | |

FOREIGN PATENT DOCUMENTS

| | | |
|---|---|---|
| 1009348 | 5/1957 | Germany . |
| 26 56 040 | 6/1978 | Germany . |
| 2119440 | 11/1983 | Germany . |
| 5-99200 | 4/1993 | Japan . |
| 42588 | 1/1960 | Poland . |
| 113765 | 11/1957 | U.S.S.R. . |
| 693053 | 10/1979 | U.S.S.R. . |
| 803422 | 10/1958 | United Kingdom . |
| 822084 | 10/1959 | United Kingdom . |
| 1143989 | 2/1969 | United Kingdom . |
| 1502781 | 3/1978 | United Kingdom . |

OTHER PUBLICATIONS

Catalog 450–D, Twin City Fan & Blower Co., entitled Plenum (Plug) Fans – Type AFPF, Dec. 1993.

*Primary Examiner*—Christopher Verdier
*Attorney, Agent, or Firm*—Cummings & Lockwood

[57] ABSTRACT

A centrifugal fan apparatus for installation in an air plenum adapted to provide pressurized air to a ventilating system includes a centrifugal fan rotor having front and rear sidewalls and a number of blades extending between these sidewalls. The platform has a horizontal base frame on which wheels are rotatably mounted. The front sidewall has a central opening for receiving air while the rear sidewall is attached to a rotatable drive shaft that extends rearwardly from the rotor. A motor is connected to the shaft in order to rotate it and the rotor. A linearly movable platform supports the rotor, shaft and motor and an actuator moves this platform forwardly or rearwardly in order to control the volume of air flowing out of the rotor. An air inlet member is mounted rigidly at the central opening and has a generally cylindrical section that can extend into the rotor when the rotor is moved to a forward position.

17 Claims, 6 Drawing Sheets

FAN SYSTEM WITH VARIABLE AIR VOLUME CONTROL

BACKGROUND OF THE INVENTION

This invention relates to centrifugal fans and, in particular, such fans provided with a mechanism for controlling the volume of air flowing through the fan.

Centrifugal type fans are well known for use in ventilation systems for buildings and other large structures. Such fans can have an air inlet at one end through which air is drawn into the interior of the fan and the air is then driven radially outwardly by a number of blades located about the circular periphery of the fan. The fan rotor can include a circular rear wall to which the drive shaft for the fan is attached. A centrifugal fan of this type is commonly used as a plenum fan which is manufactured as an unhoused fan that can later be installed in a field erected or factory built air handing unit. In such installations, the fan wheel pressurizes the entire surrounding air plenum in which the fan is installed. Two or more air ducts can be connected to the walls of the air plenum to provide ventilating air, heated air or cooling air to the building.

It is well known that it is desirable in such fans to provide a system for regulating the flow of air through the fan. The amount of air required by a building or structure can vary during the course of a day, month or a year, depending on such factors as the outside weather, the use to which the building is being put and the areas in the building requiring ventilation or hot or cold air. Also, even if a large amount of air from the ventilation system is not required, generally some ventilation air will be required at all times in many buildings. For this reason it is generally undesirable to simply shut off the ventilation fan entirely when substantial volumes of air are not required.

One known method of regulating the flow of air through a fan is to adjust the rotational speed of the fan blades. This can be accomplished in a known manner by changing the speed of the drive motor which generally is an electric motor. It is also possible to use a transmission system which allows the motor speed to remain approximately constant but which permits the rotational speed of the shaft for the fan to be changed. Both of these systems or methods for regulating the amount of air going through a fan can give rise to problems and/or substantial additional expense.

In order to regulate the speed of an air supplying fan, it is known to use an inverter as a fan speed controller. An inverter controlled fan motor would generally retain its full load efficiency down to a minimum speed. However, it is necessary to de-rate a motor when inverter controlled and therefore the efficiency of the motor at maximum duty will be lower than for a main driven fan motor. The inverter itself absorbs some energy and this can be as much as 3% of the maximum input power.

Another difficulty with variable speed fans arises from the tip speed of the blades which reduces as the speed of the fan reduces. Generally, the pressure developed by a fan is dependent on the tip speed of the blades which speed is in turn dependent on the diameter and speed of the fan wheel. The static pressure generated by the fan is reduced by the square of reduction in the tip speed. Therefore, small reductions in volume flow (which is proportional to the fan rotational speed) cause a large decrease in the static pressure. This is a problem for buildings where a minimum static pressure needs to be maintained at all volume flows in order to be able to deliver the required air quantity to each and every zone.

Another difficulty with speed controlled fans is that the stability of the fan can be lost at relatively low volume air flow if a fixed pressure component is required in the system which is often the case. Another difficulty with such fans is that motor noise from an inverter controlled fan can be excessive due to the harmonics created by wave chopping which can be amplified and radiated by the structure of the fan. The use of silencers in the system can help reduce fan noise but they may not be capable of removing certain discrete frequencies generated in the motors by the inverter. Other problems that can arise from the use of such fans include vibrations created at certain fan speeds, electrical system effects and radio frequency interference problems.

It is an object of the present invention to provide a fan apparatus that is movable with respect to its air inlet and that thereby permits the user to control the volume of air flowing through the air inlet and the fan rotor while maintaining the constant rotational speed of the fan rotor.

It is a further object of the invention to providea fan apparatus that can be constructed and installed at a reasonable cost and that has an efficient and effective mechanism for permitting the volume of air generated by the fan to be varied without having to change the speed of rotation of the fan rotor while maintaining the constant rotational speed of the fan rotor.

SUMMARY OF THE INVENTION

According to one aspect of the invention, a fan apparatus comprises a hollow fan rotor having front and rear spaced apart, circular sides and a number of blades extending between and connecting these sides. The front side has a central opening for receiving air from an air inlet. The apparatus includes a rotatable shaft connected to the rotor for rotation of same and a drive system for rotating the shaft and rotor. There is also a linearly movable supporting device on which the rotor, shaft and drive system are mounted. An actuator is capable of moving the supporting device either forwardly or rearwardly as desired in order to control the volume of air flowing through the air inlet and the rotor during operation of the apparatus.

The supporting device of the invention has wheels and a horizontal base frame on which the wheels are rotatably mounted.

According to another aspect of the invention, a centrifugal fan apparatus for an air supplying and ventilating system includes a centrifugal fan rotor having front and rear sidewalls and a number of blades extending between and connecting the sidewalls. The front sidewall has a central opening for receiving air into the fan rotor. A rotatable drive shaft extends rearwardly from the fan rotor and is connected to the rear sidewall. A power drive system is connected to this shaft for rotating the shaft and the fan rotor. There is a linearly movable, supporting frame device on which the fan rotor, shaft and drive system are mounted and an actuator is able to move the supporting frame device forwardly or rearwardly in order to control the volume of air flowing out of the fan rotor. The supporting device includes a horizontal base frame with wheels rotatably mounted thereon. An air inlet member is provided for mounting in a rigid manner at the central opening and this inlet member has a generally cylindrical section with the maximum external diameter less than the width of the central opening. The inlet member can extend into the fan rotor when the fan rotor is moved to a forward position by the supporting frame device and the actuator.

Preferably, the air inlet member is rigidly mounted in a vertical wall and is arranged so that a central axis thereof is coaxial with the fan rotor.

According to still another aspect of the invention, a plenum fan apparatus for an air supplying and ventilating system includes a plenum housing and vertical sidewalls, one of which has an air inlet opening provided therein. The sidewalls also have one or more air outlets formed therein. A centrifugal fan rotor is located in this housing and has front and rear rotor sidewalls and a number of blades extending between and connecting these rotor sidewalls. The front rotor sidewall has a central opening formed therein for receiving air from the air inlet opening into the fan rotor. A power drive system is connected to the rear sidewall of the fan rotor in order to rotate same. A supporting device on which the rotor and drive system are mounted is linearly movable in the housing. An actuator for moving the supporting device either forwardly or rearwardly in order to control the volume of air flowing through the fan rotor and into the housing is also provided. The air inlet opening is formed by an air inlet member having a cylindrical, rearward extension. The inlet member projects into the fan rotor when the fan rotor is moved to a forward position by the supporting device and the actuator.

The preferred supporting device has both a horizontal base frame on which wheels are mounted and a horizontal upper frame mounted on the base frame by means of vibration isolating springs. The fan rotor and drive system are mounted on the upper frame.

Further features and advantages will become apparent from the following detailed description taken in conjunction with the accompanying drawings.

DETAILED DESCRIPTION OF PREFERRED EMBODIMENT

Figure 1:
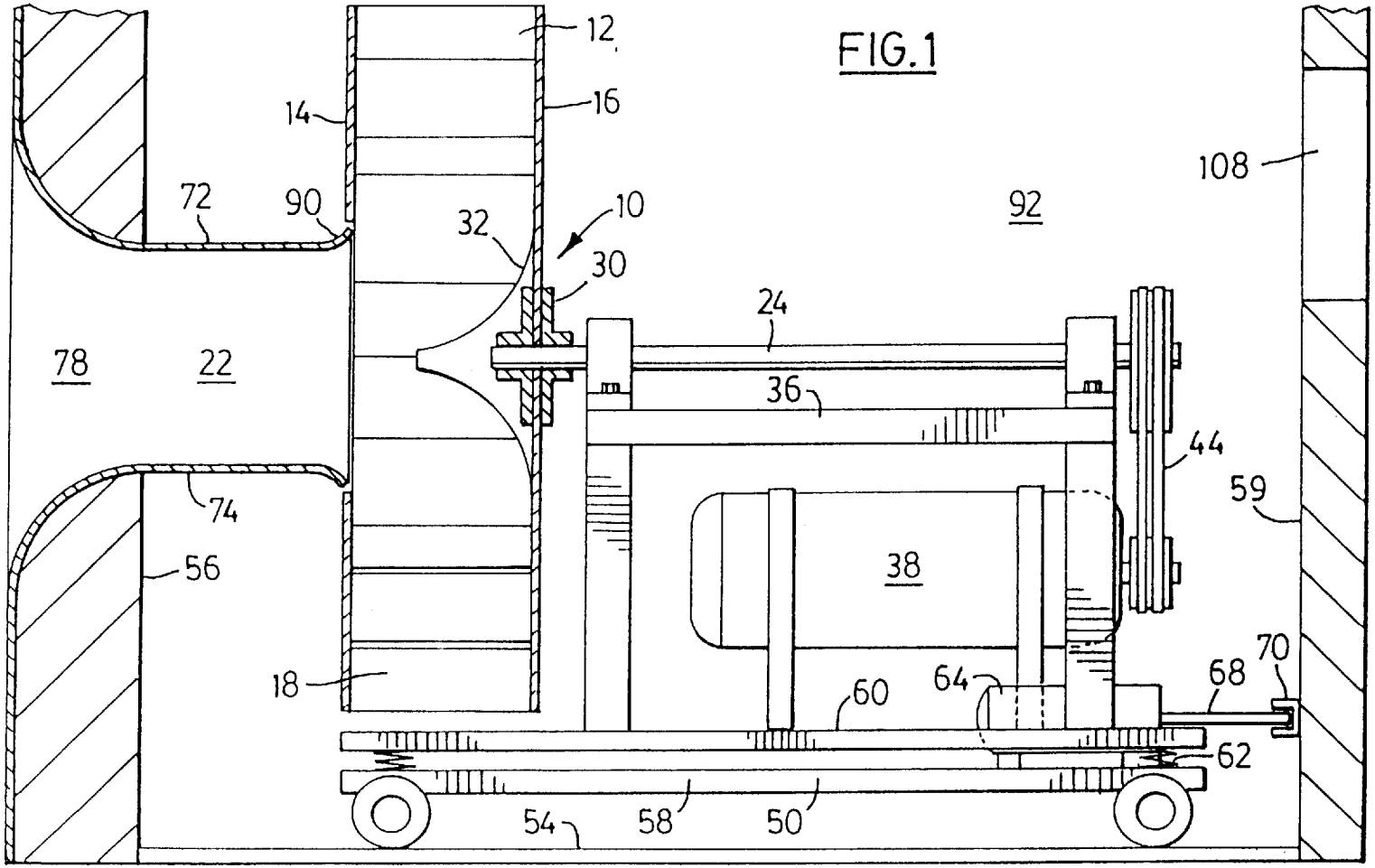
FIG. 1 is a side elevation partly in cross-section showing a fan apparatus constructed in accordance with the invention, the apparatus being shown with its fan rotor in its rearward position.

A fan apparatus 10 constructed in accordance with the invention comprises a hollow fan rotor or fan wheel 12 having a front circular side 14 and a rear circular side 16. These spaced apart sides are connected to each other by means of a number of blades 18 which, in a known manner, can have an airfoil shape. The blades 18 and the arrangement thereof in this centrifugal fan rotor are per se well known in the fan art and, accordingly, a detailed description thereof herein is deemed unnecessary. The front side 14 of the rotor has a circular central opening 20 formed therein for receiving air from an air inlet 22.

A straight, rotatable drive shaft 24 is connected to the rear of the rotor and is capable of rotating the rotor at a relatively high speed. The shaft is preferably rotatably mounted in spaced-apart bearings 26 and 28. Suitable annular support plates 29 and 30 can be provided at the front end of the shaft to firmly connect the rear side 16 of the rotor to the shaft. A conical air directing member 32 can be fixedly attached to the front of the rear side 16 for the purpose of smoothing the airflow as it enters the inside of the rotor from the inlet 22. The bearings 26 and 28 are fixedly mounted on a supporting framework 36 described in more detail hereinafter.

A drive system is provided for rotating the drive shaft 24 and the rotor. The illustrated preferred drive system is a power drive system that includes a suitable electric motor 38. As illustrated, this motor has an output shaft at its rear end on which one or more pulley members 40 are mounted. There are also one or more pulley members 42 mounted on the rear end of the drive shaft 24 and one or more drive belts which can be continuous rubber belts 44 extend between the pulley member or members of the motor and the pulley member or members 42 of the shaft 24. It will be further understood that the motor 38 can be of the constant speed variety since, with the use of the present invention, there is no need to vary the speed of the motor in order to vary the volume of air flowing from the fan rotor. If desired, the motor can be coupled directly to the shaft 24 without using the pulley/belt assembly.

Figure 5:
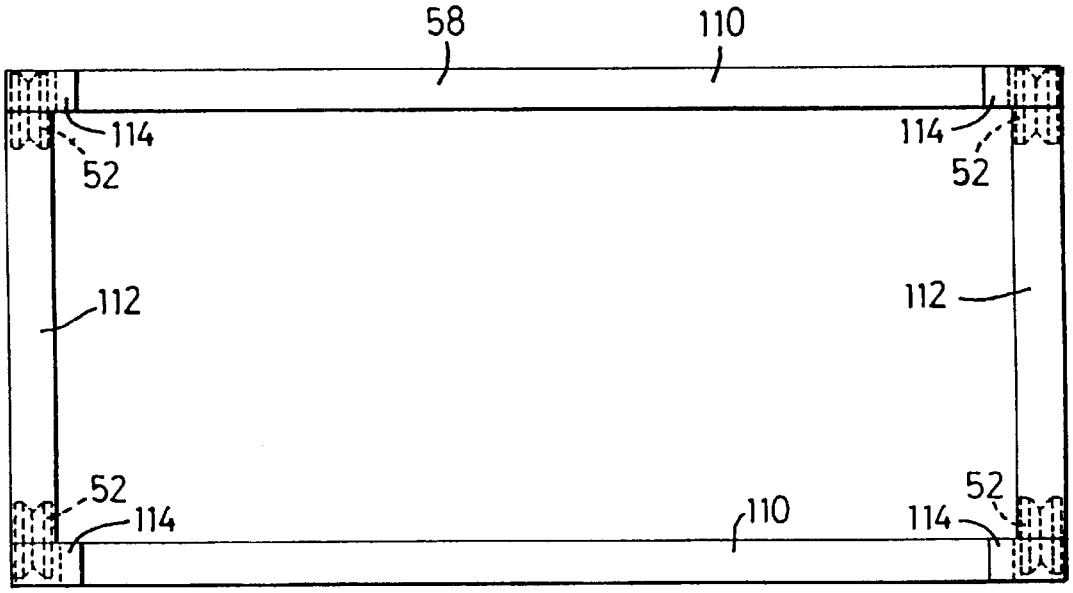
FIG. 5 is a plan view of a horizontal base frame equipped with four wheels.
Figure 6:
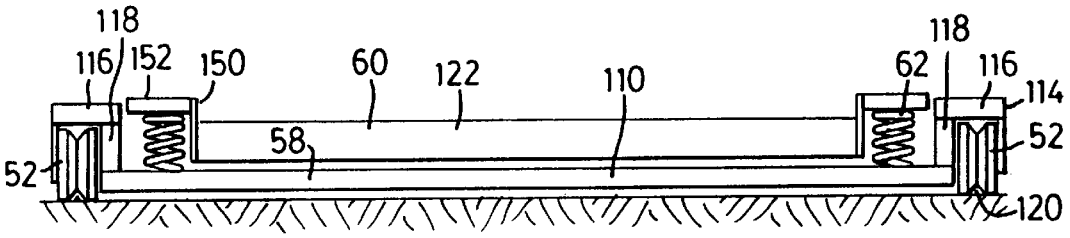
FIG. 6 is a front view showing the supporting frame device on which the fan rotor is mounted for linear movement.

The apparatus 10 includes a linearly movable supporting device indicated generally at 50 on which the fan rotor 12, the shaft 24 and the drive system including motor 38 are mounted. The preferred illustrated supporting device has four relatively small wheels 52 which can run on short, straight steel rails 54. The wheels 52 can be provided with suitable annular grooves 120 to engage the rails which can have an inverted V shape in cross-section. The two parallel rails 54 thus are able to maintain the movement of the supporting device 50 in a straight line along the desired path. The rails can extend between a front wall 56 of an air plenum in which the apparatus is mounted and a rear wall 59 of this plenum. The wheels 52 are rotatably mounted on a horizontal base frame 58. The base frame 58 can be generally flat and formed with several rigid frame members. One preferred version of this base frame is illustrated in FIGS. 5 and 6 and is described in more detail hereinafter. In addition to the base frame 58, the supporting device 50 includes a horizontal upper frame 60 which is mounted on the base frame by means of vibration isolating members. In the preferred illustrated embodiment, these vibration isolating members comprise relatively short coil springs 62 with one coil spring being provided near each of the four corners of the supporting device 50. As can be seen from FIGS. 1 and 2, the fan rotor 12, its drive shaft 24 and the drive system including motor 38 are all mounted on the upper frame 60. Thus, vibrations which can be caused by rotation of the rotor during operation thereof are substantially isolated to the upper frame 60 due to the operation of the vibration isolating springs 62. It will be understood that the coil springs 62 are the only members connecting the upper frame 60 to the base frame 58.

Figure 3:
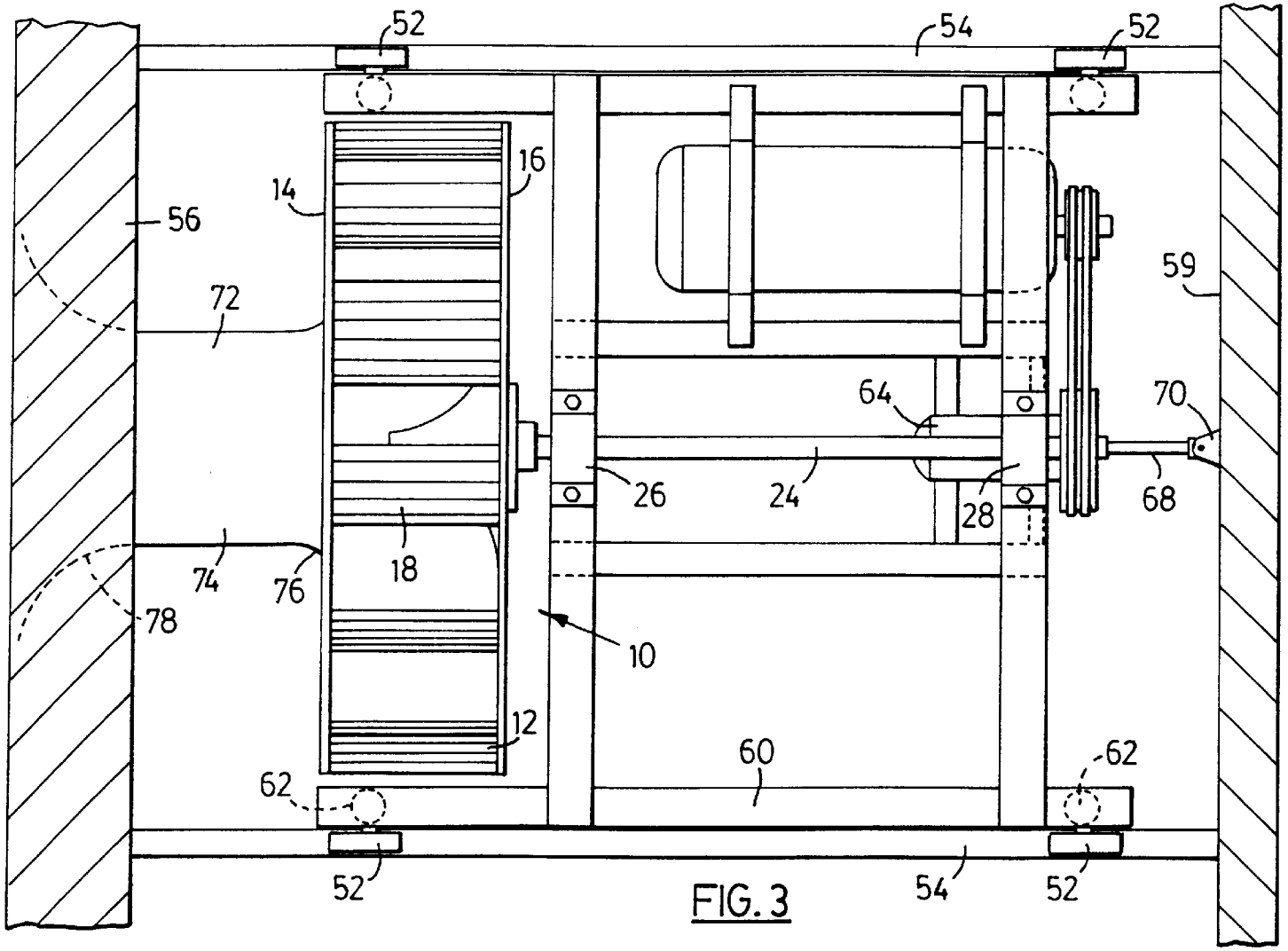
FIG. 3 is a plan view of the fan apparatus of FIG. 1 installed in an air plenum.

The fan apparatus 10 also includes an actuator indicated generally at 64 for moving the supporting device 50 forwardly or rearwardly as desired in order to control the volume of air flowing through the air inlet 22 and the rotor 12 during operation of the apparatus. The actuator 64 can be a standard hydraulic actuator, a standard pneumatic actuator, or an electric actuator of known construction and accordingly a detailed description herein is deemed unnecessary. In the case of the illustrated pneumatic actuator, there is a pneumatic cylinder 66 and an actuator rod 68 with the cylinder being mounted on the base frame 58 so that it is not affected by the vibrations caused by fan rotation. Preferably the actuator 64 is mounted centrally on the base frame 58 taken in a transverse direction thereof (as illustrated in FIG. 3). When the apparatus is installed, the rear or outer end of the rod 68 can be attached by a suitable bracket 70 to the rear wall 59 of the plenum. Of course, instead of using the rear wall, it is also possible to use some other form of fixed support located in the plenum for attachment of the outer end of the actuator rod 68. For example, one could use a rigid post attached to the floor of the plenum, if desired. The central mounting of the actuator 64 is desirable in order to prevent undue wear on the components including the actuator and to ensure that the supporting device 50 is in fact moved in the required straight line forwardly or rearwardly. The cylinder 66 is mounted adjacent a rear end of the base frame 58 so that the length of the actuator rod 68 need be no longer than necessary for operation of the apparatus.

An inlet member 72 can be provided with the apparatus 10, the member 72 forming the aforementioned air inlet 22. The preferred inlet member has a generally cylindrical section 74 having a maximum external diameter that is preferably slightly less than the diameter of the central opening 20 in the front side of the rotor. If desired, the rear end of this cylindrical section can have a curved, outward flare 76 at its rear end. For reasons which will become clear hereinafter, the length L of the cylindrical section should be about equal to the internal width W of the rotor. In this way, a maximum variation in the volume of air flowing through the rotor is possible with the apparatus 10.

Preferably the inlet member 22 has a bell-shaped front section 78 and the cylindrical section 74 extends rearwardly from this front section in a smooth, continuous manner. Thus, the diameter of the inlet member at the rear end of front section 78 is equal to the diameter at the front end of the cylindrical section 74. Preferably the inlet member 22, which can be made of a suitable metal, is rigidly and fixedly mounted in a vertical wall of the plenum. As illustrated, this vertical wall is the front wall 56 which preferably is insulated in a known manner with sound insulating material indicated at 80. It will be understood that the other walls of the plenum are also preferably covered with this sound insulating material. The inlet member 72 is mounted so that it is coaxial with the fan rotor 12.

The manner in which the apparatus 10 is able to vary the volume of air flowing from the rotor 12 will now be explained with particular reference to FIGS. 1 and 2.

FIG. 1 illustrates the position of the fan rotor, its drive shaft and the supporting device 50 in their rearwardmost position. In this position, the rear end 90 of the inlet member 72 is located just at the central opening 20 in the front of the fan rotor. It will be understood that this position is achieved by movement of the actuator rod 68 into the pneumatic cylinder. In this position, the full width of the fan blades 18 is available and can be used to draw air into the fan and to pressurize the plenum chamber 92 to the fullest extent possible.

Figure 2:
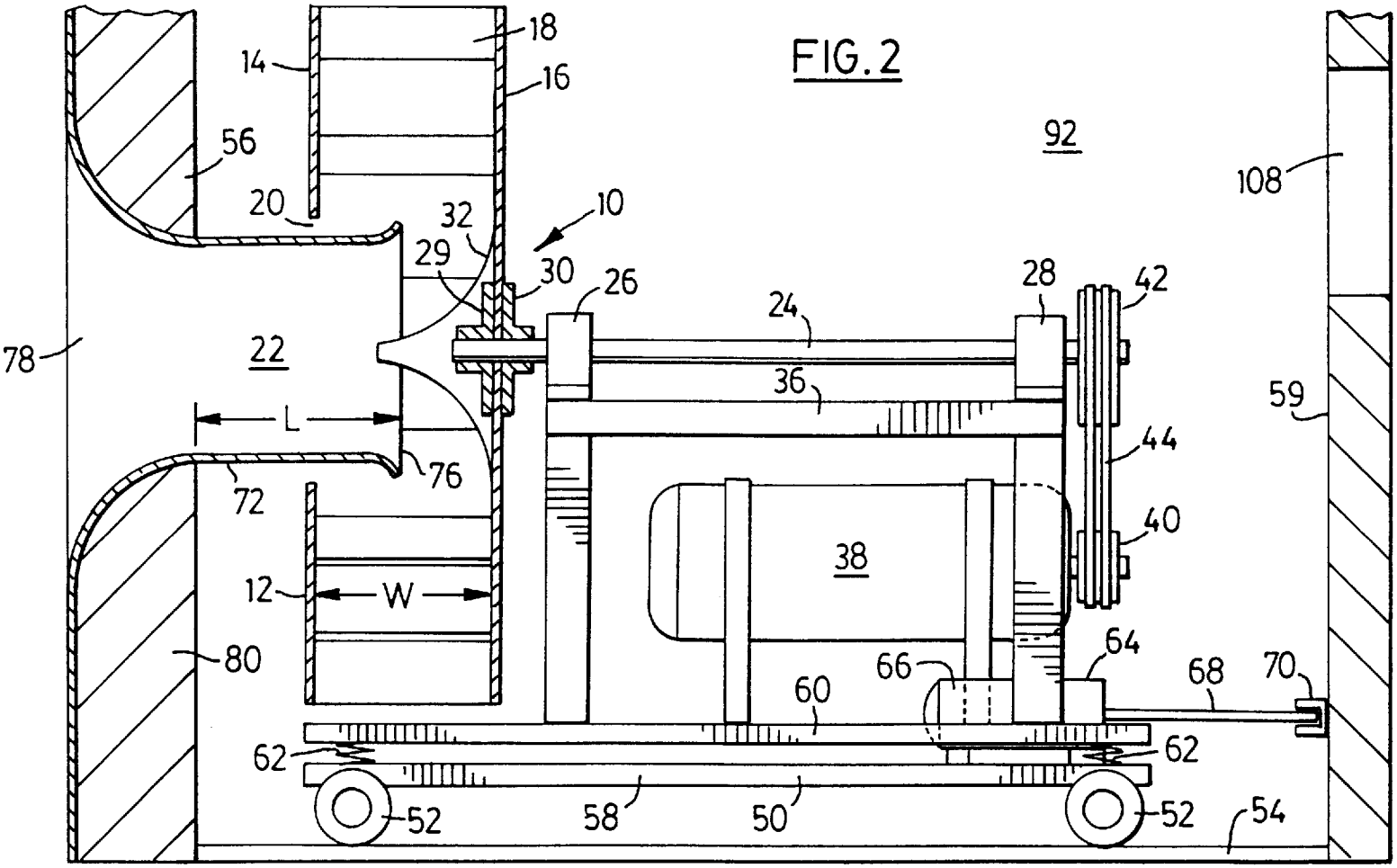
FIG. 2 is a side elevation similar to FIG. 1 but showing the fan rotor moved to a forward position and showing an air inlet member extending into the fan rotor.

If one then wishes to reduce the volume of air flow from the fan without reducing the rotational speed of the motor and the rotor, the fan rotor 12 can be moved forwardly to a forward position such as that shown in FIG. 2. In the illustrated position, the inlet member 72 extends into the interior of the fan rotor and its rear end is approximately midway between front side 14 and the rear side 16. In this position, only a rearward portion, for example, the rear half of the blades 18, is operational and is available to pull air into the fan and to pressurize the plenum. It will be appreciated that a number of different forward positions are possible so that the amount of variation in the air flow from the fan is substantial. For example, the rear end of the inlet member 72 can be brought to a position close to rear wall 16 in which case the volume air from the fan would be minimal. Alternatively, it is possible to position the fan rotor so that the inlet member extends only a short distance into the rotor, thus reducing the volume of air flow only a small amount.

Figure 4:
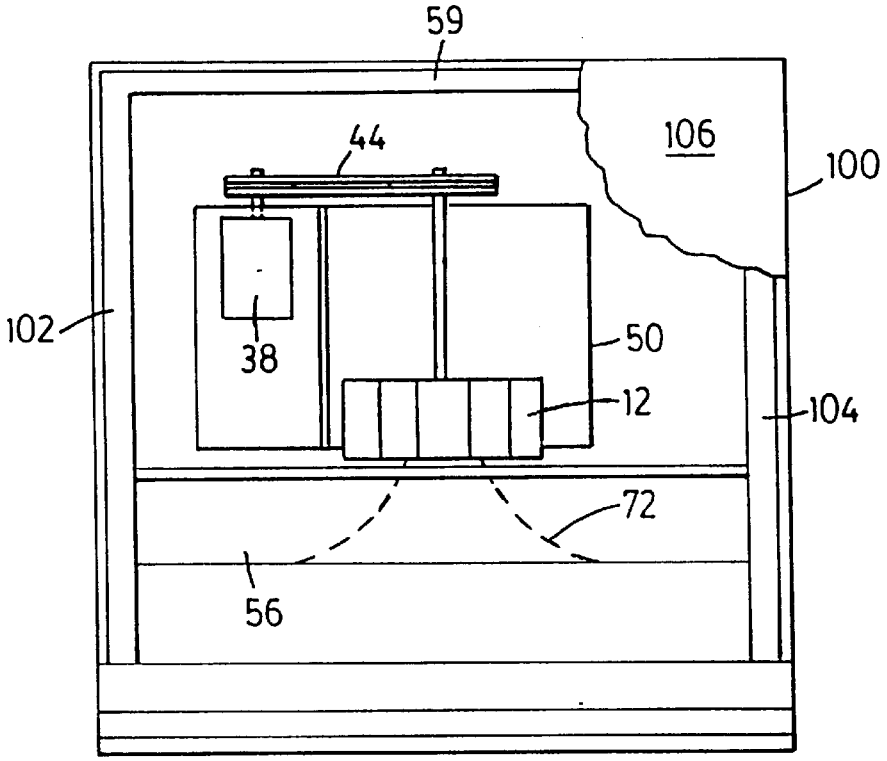
FIG. 4 is another plan view of the fan apparatus including an air plenum, this view showing the four vertical walls of the air plenum and a portion of its ceiling.

FIG. 4 illustrates in plan view a plenum fan apparatus for an air supplying and ventilating system, this apparatus being constructed in accordance with the invention. The plenum apparatus includes a plenum housing indicated generally at 100. The illustrated housing includes four vertical side walls including the aforementioned front wall 56 and rear wall 59 and two side walls 102 and 104 that extend between the front and rear walls. As indicated, each of these walls can be insulated with a sound insulating material in a known manner. The top of the housing is covered by a top wall 106, only a corner of which is shown for sake of illustration. It will thus be appreciated that the plenum housing is enclosed on all sides including at the bottom by means of the floor of the building or structure. Such air plenums are Per se well known in the air handling and air ventilating industry. It will be further understood that the side walls and the top wall can be provided with one and generally two or more air outlets 108, one of which is illustrated in FIGS. 1 and 2. It will thus be appreciated that operation of the fan apparatus 10 will cause the chamber 92 in the plenum housing to be pressurized and this in turn will cause air to flow through the outlets into air ducts that carry air under pressure to various areas in the building or structure.

FIGS. 5 and 6 show further details of a preferred embodiment of the horizontal base frame which is a major component of the supporting device 50. The base frame 58 comprises two long, parallel frame members 110 and two shorter, parallel frame members 112. The members 110 and 112 can be connected together at each corner by a L-shaped connecting piece 114. In this way the frame members 112 are elevated a short distance above the members 110 and the four wheels 52 can be positioned below the frame members 112. Each L-shaped connector 114 can comprise a short horizontal frame piece 116 welded to a short, vertical frame piece 118 as indicated in FIG. 6. The support shafts for the wheels 52 can be rotatably connected to the ends of the adjacent frame 110.

Figure 8:
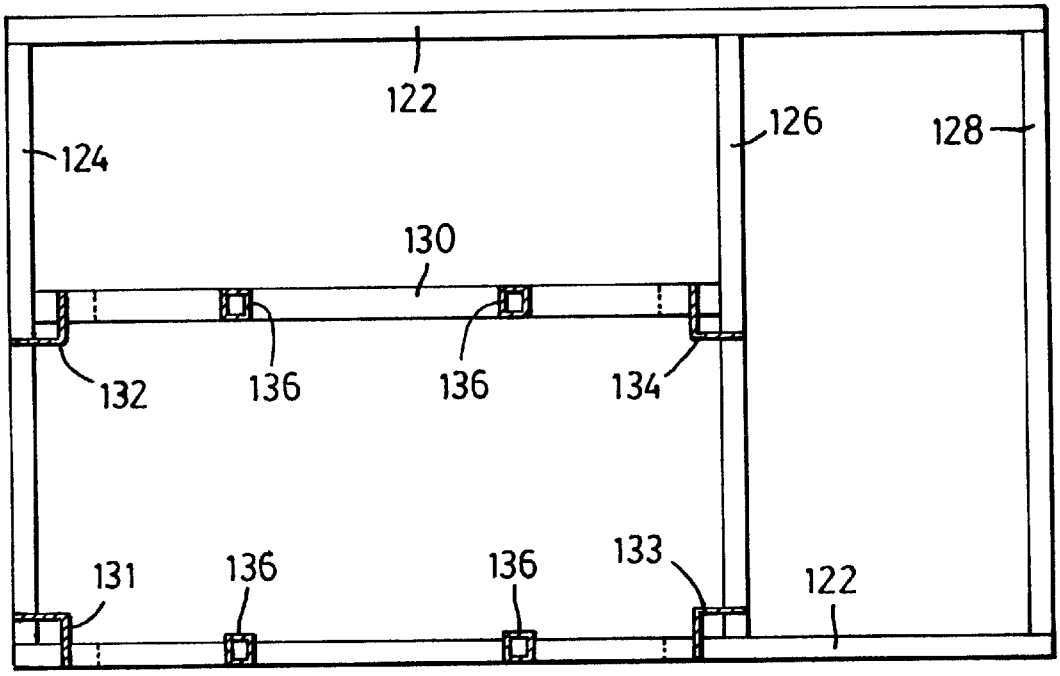
FIG. 8 is a plan view showing details of a horizontal frame on which the fan and its drive system are mounted, this view being taken along the line VIII—VIII of FIG. 7.

Further details of the upper frame 60 are also shown in FIGS. 6 and 8. This frame includes two relatively long, frame members 122 that extend parallel to the members 110. The frame members 122 are connected together by means of three, parallel shorter frame members 124, 126 and 128 with the frame members 124 and 128 being located at opposite ends of the members 122. A further internal frame member 130 extends between members 124 and 126 and is parallel to the members 122. To provide the supporting framework for the drive shaft 24, four upright post members 131 to 134 extend upwardly from the upper frame at the positions indicated in FIG. 8. These upright frame members can be made with steel angle members. In addition to these upright members, there can also be provided four upright tubular members 136 to increase the rigidity of the framework.

Figure 9:
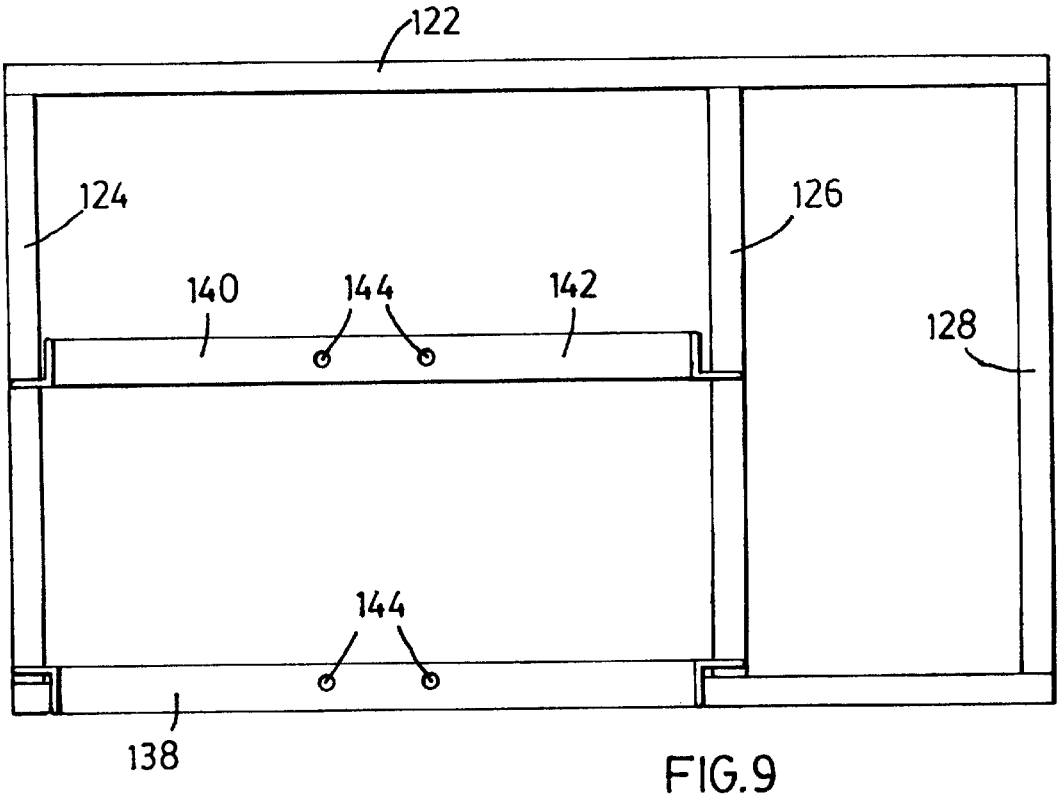
FIG. 9 is a plan view showing details of an elevated framework used to support the fan rotor and its drive shaft, this view being taken along the line IX—IX of FIG. 7.

Connecting the tops of the uprights 131 to 134 and members 136 are two, horizontally extending frame members 138 and 140 shown in FIG. 9. These may be formed of steel angle members having an upper surface 142 on which the bearings 26, 28 for the drive shaft are mounted by means of bolts and bolt holes indicated at 144.

FIG. 6 illustrates also how the upper frame 60 in this preferred embodiment can be connected by the springs 62 to the base frame 58. In this version, L-shaped connecting members are attached at the corners of the upper frame and the bottom of each horizontal portion 152 rests on the top of its respective spring and is connected thereto by any suitable means.

Figure 7:
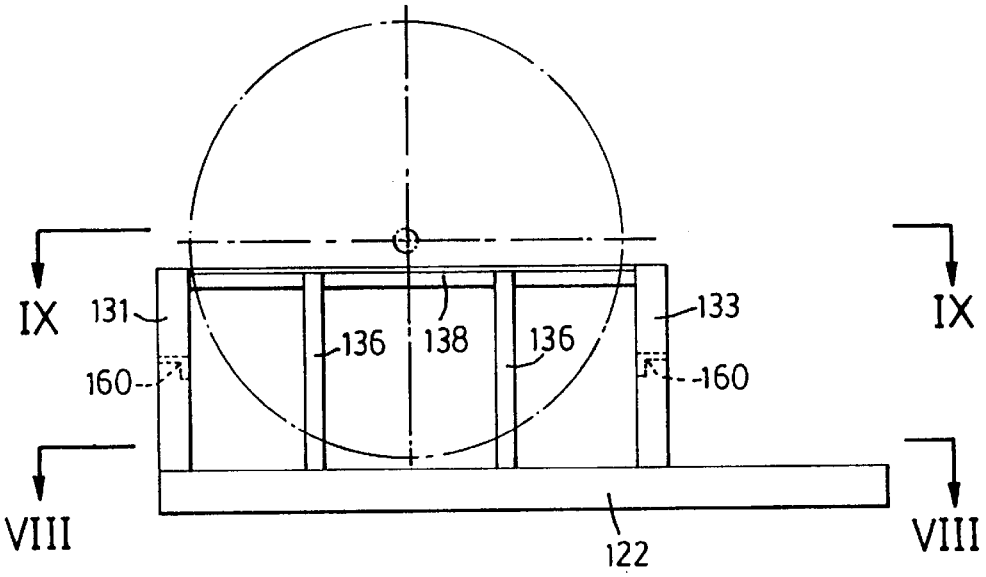
FIG. 7 is a front detail view showing an upper frame and further frame structure used to rotatably support the fan rotor.

To increase the rigidity of the supporting framework, horizontal connecting frame members 160 also extend between the upright frames 131, 132 and 133, 134 as indicated in dashed lines in FIG. 7. These can be steel angle members.

Performance tests were conducted on a variable volume fan system constructed in accordance with the invention. The volume flow was measured with a hand-held, calibrated turbine meter positioned in front of the fan inlet. The static pressures were measured with calibrated pressure gauges mounted to measure the air pressure inside and outside the air plenum. The Table 1 set out below shows the effect of moving the fan over the inlet bellmouth.

TABLE 1

| FLOW CFM | STATIC PRESSURE IN W.G. | POWER HP | EFFICIENCY % | TRAVEL (in.) |
|---|---|---|---|---|
| 35100 | 4.0 | 33 | 68 | 0 |
| 31600 | 3.4 | 28 | 61 | 1.0 |
| 26100 | 2.7 | 23 | 46 | 4.0 |
| 20400 | 2.1 | 21 | 32 | 5.5 |

As the flow volume decreases, the static pressure is reduced. If one used a conventional approach to reduce the air volume from the fan and reduced the fan rotational speed, the reduction in pressure would be greater. With the use of the present system, the pressure reduction is virtually linear and scales directly with the volume flow.

It will be understood that the linear actuator can be controlled by any suitable, known control mechanism, including a manually operated control, if desired. It could, for example, be controlled by conventional switching means such as a contact control mechanism which is connected to sensing means, such as photohelic static pressure probes located at predetermined locations in the environmental control system of the building or structure. In this way, it is possible in a known manner to set up an automatic control system to provide the required volume of air to the building or structure.

It will be clear to those skilled in this art that various modifications and changes can be made to the described fan apparatus without departing from the spirit and scope of this invention. Accordingly, all such modifications and changes as fall within the scope of the appended claims are included in this invention.

We claim:

1. A plenum fan apparatus for an air supplying and ventilating system, said apparatus comprising:

a plenum housing including vertical sidewalls, one of said sidewalls having an air inlet opening provided therein, said sidewalls also having one or more air outlets formed therein;

a centrifugal fan rotor located in said housing and having front and rear sidewalls and a number of blades extending between and connecting said sidewalls, the front sidewall having a central opening formed therein for receiving air from said air inlet opening into the fan rotor;

a power drive system connected to said rear sidewall of the fan rotor for rotating said fan rotor;

a supporting device on which said rotor and drive system are mounted, said supporting device being linearly movable in said housing and having a horizontal base frame on which wheels are rotatable mounted; and an actuator for moving said supporting device either forwardly or rearwardly, in order to control the volume of air flowing through said fan rotor and into said housing;

wherein said air inlet opening is formed by an air inlet member having a cylindrical, rearward extension and said inlet member projects into said fan rotor when said fan rotor is moved to a forward position by said supporting device and said actuator.

2. A plenum fan apparatus according to claim 1 wherein said supporting device includes a horizontal upper frame mounted on said base frame by means of vibration isolating springs, said fan rotor and drive system being mounted on said upper frame.

3. A plenum fan apparatus according to claim 2 wherein said drive system includes a drive shaft connected to said rear sidewall of the fan rotor, an electric motor mounted on said upper frame, and one or more drive belts extending between said motor and said shaft.

4. A plenum fan apparatus according to claim 3 wherein said actuator comprises a pneumatic cylinder mounted on said supporting device and an actuator rod slidably mounted in said cylinder and connectible to a fixed support.

5. A centrifugal fan apparatus for an air supplying and ventilating system, said apparatus comprising:

a centrifugal fan rotor having front and rear sidewalls and a number of blades extending between and connecting said sidewalls, the front sidewall having a central opening for receiving air into the fan rotor;

a rotatable drive shaft extending rearwardly from said fan rotor and connected to the rear sidewall;

a power drive system connected to said shaft for rotating said shaft and fan rotor;

a linearly movable, supporting frame device on which said fan rotor, shaft and drive system are mounted, said supporting frame device including a horizontal base frame with wheels rotatable mounted thereon;

an actuator for moving said supporting frame device forwardly or rearwardly in order to control the volume of air flowing out of said fan rotor; and an air inlet member for mounting in a rigid manner at said central opening, wherein said inlet member has a generally cylindrical section with a maximum external diameter equal to or less than the width of said central opening so that said inlet member can extend into said fan rotor when said fan rotor is moved to a forward position by said supporting frame device and said actuator.

6. A fan apparatus according to claim 5 wherein said air inlet member is rigidly mounted in a vertical wall and arranged so that a central axis of said air inlet member is coaxial with said fan rotor.

7. A fan apparatus according to claim 6 wherein said inlet member has a bell-shaped front section and said cylindrical section of said inlet member extends rearwardly from said front section, which front section is connected to said vertical wall.

8. A fan apparatus according to claim 5 wherein said supporting frame device includes an upper frame mounted on said base frame by means of vibration isolating members, said fan rotor, shaft and drive system being mounted on said upper frame.

9. A fan apparatus according to claim 8 wherein said actuator comprises a pneumatic cylinder and an actuator rod movable in said cylinder, said cylinder being mounted on said base frame adjacent a rear end of said base frame.

10. A fan apparatus comprising:

a hollow fan rotor having front and rear spaced apart, circular sides and a number of blades extending between and connecting said sides, the front side having a central opening for receiving air from an air inlet;

a rotatable shaft connected to said rotor for rotation of same;

a drive system for rotating said shaft and rotor;

a linearly movable supporting device on which said rotor, shaft and drive system are mounted, said supporting device having wheels and a horizontal base frame on which said wheels are rotatable mounted; and an actuator for moving said supporting device either forwardly or rearwardly as desired in order to control the volume of air flowing through said air inlet and said rotor during operation of the apparatus.

11. A fan apparatus according to claim 1 wherein said supporting device includes a horizontal upper frame mounted on said base frame by means of vibration isolating members, said rotor, shaft and drive system are mounted on said upper frame, and vibrations from said rotor during operation thereof are substantially isolated to said upper frame due to the operation of said vibration isolating members.

12. A fan apparatus according to claim 11 wherein said vibration isolating members are coil springs connecting said upper frame to said base frame.

13. A fan apparatus according to claim 11 including one or more bearings rotatably supporting said shaft and a supporting framework on which said one or more bearings are mounted, said supporting framework being rigidly connected to said upper frame and supporting said shaft in a horizontal position elevated above said upper frame.

14. A fan apparatus according to claim 10 wherein said actuator is pneumatically driven and includes a pneumatic cylinder and an actuator rod, said cylinder being mounted on said supporting device.

15. A fan apparatus according to claim 11 wherein said actuator is pneumatically driven and includes a pneumatic cylinder and an actuator rod, said cylinder being mounted centrally on said base frame taken in a transverse direction relative to said base frame.

16. A fan apparatus according to claim 10 including an inlet member forming said air inlet and having a generally cylindrical section having a maximum external diameter equal to or slightly less than the diameter of said central opening in said front side, which central opening is circular.

17. A fan apparatus according to claim 16 wherein said inlet member has a bell-shaped front section and said cylindrical section of said inlet member extends rearwardly from said front section and wherein said apparatus includes means for rigidly and fixedly mounting said inlet member so that the inlet member is coaxial with the fan rotor.

* * * * *